US006187069B1

(12) United States Patent
Hoshi et al.

(10) Patent No.: US 6,187,069 B1
(45) Date of Patent: Feb. 13, 2001

(54) COMPOSITE BOND WHEEL AND WHEEL HAVING RESIN BONDING PHASE

(75) Inventors: Junji Hoshi; Kenichi Suzuki, both of Iwaki; Yoshitaka Ikeda; Yoshihiro Sawada, both of Ohmiya, all of (JP)

(73) Assignee: Mitsubishi Materials Corporation, Tokyo (JP)

( * ) Notice: Under 35 U.S.C. 154(b), the term of this patent shall be extended for 0 days.

(21) Appl. No.: 09/405,220

(22) Filed: Sep. 27, 1999

(30) Foreign Application Priority Data

Sep. 25, 1998 (JP) ..... 10-272295
Nov. 6, 1998 (JP) ..... 10-316650

(51) Int. Cl.[7] ..... B24D 3/02; B24D 17/00; B24D 3/00

(52) U.S. Cl. ..... 51/298; 51/296; 51/307; 51/308; 51/309; 451/540; 451/541; 451/548; 451/552

(58) Field of Search ..... 451/540, 541, 451/548, 552; 51/298, 307, 308, 309, 293, 296

(56) References Cited

U.S. PATENT DOCUMENTS 3,850,590 * 11/1974 Chalkley et al. ..... 51/309
4,373,934 2/1983 Hayden .
4,385,907 5/1983 Tomita et al. .
5,224,968 7/1993 Chambers .
5,273,559 * 12/1993 Hammar et al. ..... 51/309
5,651,729 7/1997 Benguerel .
5,738,695 * 4/1998 Harmer et al. ..... 51/309

FOREIGN PATENT DOCUMENTS 55-075461 6/1980 (JP) .
6-71568 3/1994 (JP) .

* cited by examiner

*Primary Examiner*—Michael Marcheschi
(74) *Attorney, Agent, or Firm*—Oblon, Spivak, McClelland, Maier & Neustadt, P.C.

(57) ABSTRACT

The present invention provides a composite bond wheel that has both excellent wear resistance and self-edging properties. The composite bond wheel of the invention includes:

a grain layer including abrasive grains and a bonding phase;

wherein the bonding phase includes a metal bonding phase and a resin bonding phase, wherein said metal bonding phase includes a metal having the abrasive grains and outside-opening pores dispersed therein, and wherein at least a portion of the outside-opening pores are filled with a resin of the resin bonding phase.

23 Claims, 3 Drawing Sheets

Fig,1
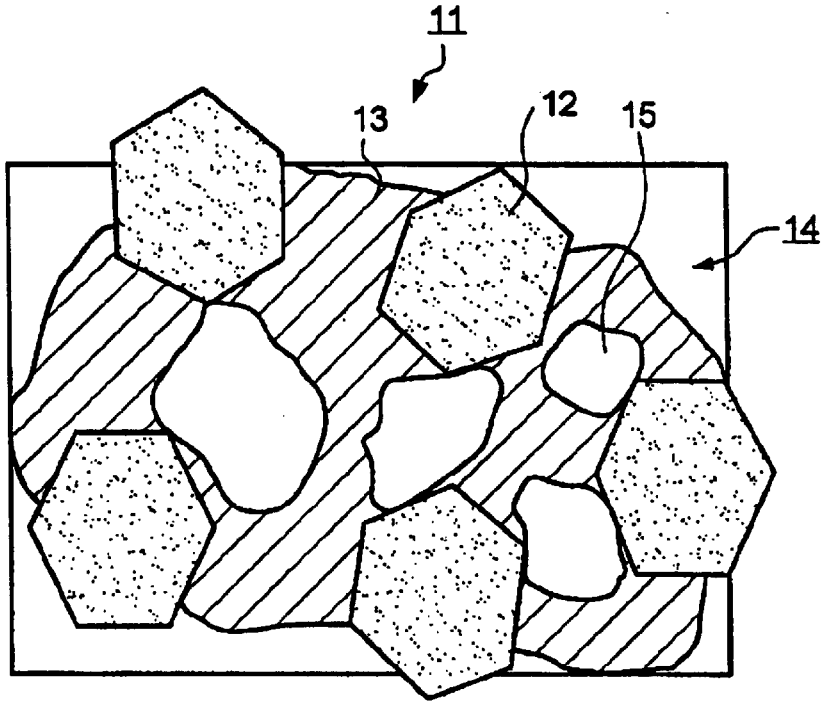
Fig,2
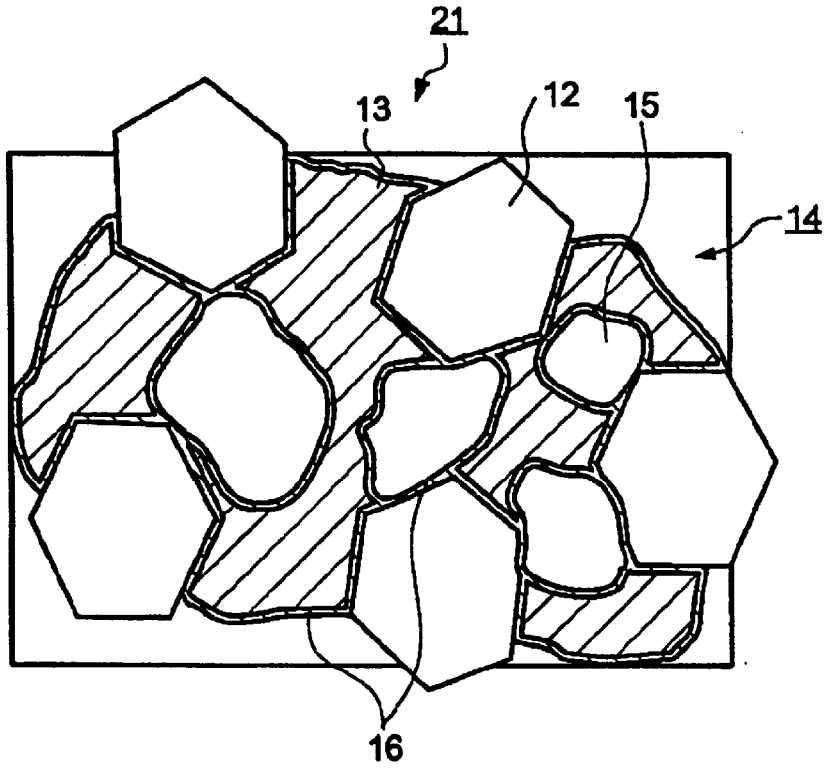

Fig,3
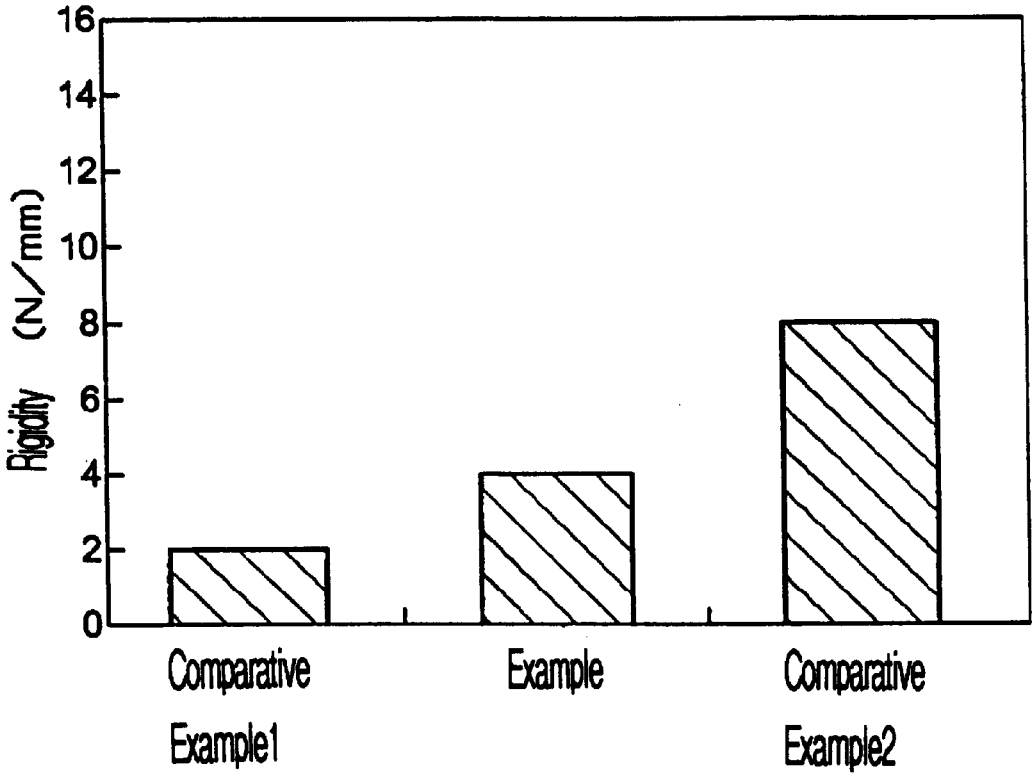
Fig,4
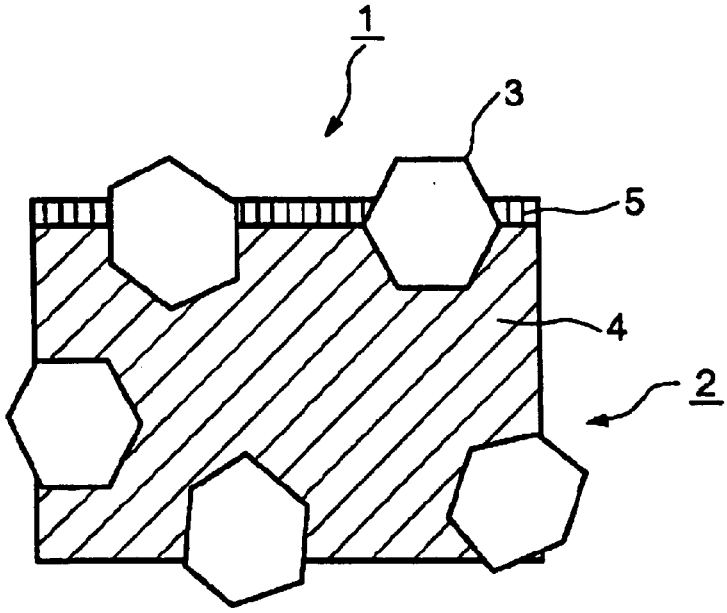

Fig,5
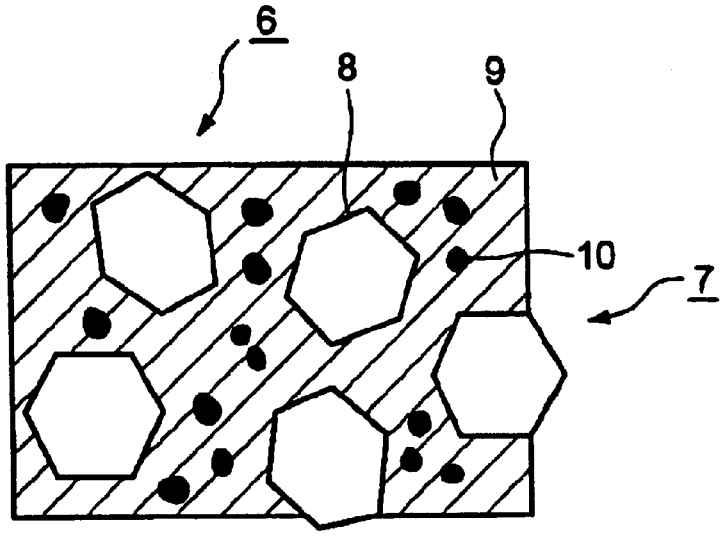

COMPOSITE BOND WHEEL AND WHEEL HAVING RESIN BONDING PHASE

BACKGROUND OF THE INVENTION

1. Field of the Invention

The present invention relates to a wheel used for the cutting, grooving, polishing, grinding and the like of various materials.

2. Description of the Related Art

Ceramic materials such as alumina and silicon nitride have recently been employed as precision parts of electric devices and the like in increasing quantities. Accordingly, there is an increasing demand for high accuracy in the fabrication of these materials, which are difficult to grind.

A metal bond wheel or a resin bond wheel provided with super abrasive grains such as CBN or diamond grains is typically used for the fabrication of such difficult-to-grind materials.

In a metal bond wheel, super abrasive grains are held in a dispersion arrangement or dispersed in a metal bond phase that contains a single kind of metal or alloy. Because the metal bond phase is hard, the metal bond wheel is hardly worn by friction with the work or is hardly chipped, and is therefore excellent in wear resistance. On the other hand, however, a very strong holding force of grains leads to a poor self-edging function, in which super abrasive grains projecting from the surface of the metal bond wheel gradually fall off and are replaced by fresh super abrasive grains. This results in the deterioration of sharpness at the tips of the super abrasive grains, which become dull under the effect of wear.

In a resin bond wheel, super abrasive grains are held in a dispersion arrangement or dispersed in a resin bond phase that contains, for example, a thermosetting resin. The resin bond phase has excellent self-edging properties, permitting a longer duration of a satisfactory sharpness. However, the resin bond wheel suffers from early wear and insufficient strength, prevent high-speed wheel or high-speed cutting.

There is therefore a demand for a composite bond wheel which has both the excellent wear resistance of a metal bond phase and the excellent self-edging properties of a resin bond phase, in a good balance.

To cope with such a demand, various improvements have been suggested over the conventional metal bond wheel and the conventional resin bond wheel.

The aforementioned improvements in the conventional art will now be described with reference to FIGS. 4 and 5.

FIG. 4 is an enlarged sectional view illustrating a typical metal bond wheel. In this metal bond wheel 1, super abrasive grains 3 including, for example, diamond abrasive grains are held in a dispersion arrangement by a metal phase 4 including, for example, Ni in a grain layer 2. A phenol resin, for example, is baked onto the surface of the metal phase 4 and is covered with a resin phase 5, and the super abrasive grains 3 are exposed on the resin phase 5.

FIG. 5 is an enlarged sectional view illustrating a typical resin bond wheel. In this resin bond wheel 6, super abrasive grains 8 including, for example, diamond abrasive grains are held in a dispersion arrangement in a resin bond phase 9 including, for example, a resin such as a polyimide resin in a grain layer 7. In the resin bond phase 9, mixed metal powder including, for example, copper and tin serving as a metal filler 10 is added in a dispersion arrangement.

In the metal bond wheel 1, described above, having a soft resin phase 5 formed through baking onto the surface of the metal phase 4, the resin phase 5 is worn out by friction with the work or by chipping, and at the point when the wear of the super abrasive grains 3 causes a deterioration of sharpness, grains fall off the resin phase 5, and self-edging functions cause fresh super abrasive grains 3 to project from the surface of resin phase 5.

The resin phase 5 is provided, however, only on the surface of the metal phase 4. If wear of the resin phase 5 proceeds and the resin phase 5 disappears completely, there would remain only the metal phase 4 holding the super abrasive grains 3 with the metal alone, thus leading to a deterioration of the self-edging properties. Therefore, when the metal bond wheel 1 is used for the fabrication of a hard and brittle material, for example, the resin phase 5 disappears at an early stage, resulting in the deterioration of the finished surface quality of the workplace.

In the resin bond wheel 6 described above, the particles of metal powder added as the metal filler 10 to the resin bond phase 9 are individually isolated, and no bonding state is formed between metal particles. This resin bond wheel 6 is therefore poor in improving the wear resistance of the resin bond phase 9 against friction with the work or chipping, and it has been heretofore impossible to prevent rapid wear, which is a defect of the resin bond wheel.

SUMMARY OF THE INVENTION

The present invention was developed in view of the aforementioned circumstances, and one object of the present invention is to provide a wheel which maintains satisfactory sharpness with self-edging upon cutting, grooving or polishing various works, and which is excellent in wear resistance.

These and other objects of the invention have been solved by the present invention, the first aspect of which provides a composite bond wheel having a grain layer with abrasive grains and a bonding phase which includes a metal and a resin, wherein the abrasive grains are dispersion-arranged in the metal; wherein pores opening outside are dispersion-arranged in the metal; and the wherein pores are filled with the resin.

In the composite bond wheel of the first aspect of the invention, in which the pores opening outside are dispersion-arranged, the bonding phase is more easily worn out as compared with a bonding phase formed with only the metal as in the conventional metal bond wheel, thus causing easy occurrence of falling out of the abrasive grains and self-edging. Further, because of the dispersion arrangement of the pores over the entire metal, it is possible to maintain satisfactory sharpness since self-edging occurs repeatedly upon grinding.

The pores are filled with the resin. Elasticity is therefore imparted to the abrasive grains projecting from the surface of the composite bond wheel, particularly as compared with the case where the abrasive grains are held by the metal alone. It is thus possible to desirably alleviate mechanical impact between the work and the abrasive grains during grinding and to reduce scratches on the ground surface of the work or chipping produced on the cut surface thereof.

The metal in the first aspect of the invention has a crosslinked structure, and metal particles are bonded together with no isolated portion. A stronger force holding the abrasive grains is therefore available as compared with the case of holding grains with the resin alone as in the conventional resin bond wheel. This results in a higher wear resistance against friction with the work or chipping, thus extending the service life of the wheel. Further, because of its good thermal conductivity and high strength, the wheel of the invention is applicable, for example, as a sharp-edge wheel or a thin-edge blade.

In the composite bond wheel of the second aspect of the invention, the aforementioned metal includes cobalt.

In the composite bond wheel of the second aspect, the metal includes cobalt (Co): when forming a metal having pores opening outside by sintering a metal powder containing cobalt, sintering does not take place on the outer surfaces of the cobalt powder particles, resulting in relatively many non-reacting portions. It is therefore possible to increase the volume of pores contained in the metal after sintering, and adjust the volume of pores by acting on the amount of the cobalt powder.

In place of or in addition to cobalt serving as a porous constituent, the metal may preferably include, for example, nickel, iron, zinc or copper, and further, may contain tin or silver as a bonding constituent.

In the composite bond wheel of the third aspect of the invention, the pores account for 5 to 60 vol. % relative to the total volume of the grain layer.

In the composite bond wheel of the third aspect, it is possible to adjust wear resistance and occurrence of self edging of the abrasive grains by means of the volume of pore dispersion-arranged in the metal. With a volume of pores of under 5 vol. % relative to the total volume of the grain layer, however, the very strong force holding the abrasive grains makes it difficult for self-edging to occur, leading to a lower grinding accuracy. With a pore volume of over 60 vol. %, on the other hand, the force holding the abrasive grains becomes lower, leading to a shorter service life of the composite bond wheel.

In the composite bond wheel of the fourth aspect of the invention, the outer surface of the metal is covered with the resin; the metal and the resin are physically integrated to form a crosslinked structure; and abrasive grains are held by the metal and the resin, respectively.

In the composite bond wheel of the fourth aspect, in which the metal and the resin have a crosslinked structure, the abrasive grains are held by the metal and the resin, respectively. It is therefore possible to simultaneously improve the grinding accuracy and the service life of wheel while keeping the balance between the self-edging function and wear resistance.

Further, since a higher elasticity is available in holding abrasive grains projecting from the surface of the composite bond wheel, it is possible, upon fabrication of, for example, a hard and brittle material, to reduce scratches on the ground surface or chipping on the cut surface and the end surface of the work, thus permitting an improvement of the finished surface quality of the work.

In the composite bond wheel of the fifth aspect of the invention, the abrasive grains and the metal are chemically bonded by a silane coupling reaction via a silane coupling agent with the resin.

In the composite bond wheel of the fifth aspect, in which the metal and the resin individually are physically integrated into crosslinked structures, and the abrasive grains are held by the metal and the resin, respectively. In addition, the abrasive grains and the resin, on the one hand, and the metal and the resin, on the other hand, are chemically bonded through a silane coupling reaction via a silane coupling agent.

The abrasive grains are therefore physically held by the metal, and further, chemically bonded and fixed to the resin, and the resin is chemically bonded also with the metal. Holding of the abrasive grains is further intensified, thus contributing to the extension of the service life of the wheel.

The wheel of the sixth aspect of the invention has a resin bonding phase, wherein the abrasive grains are dispersion-arranged in the resin bonding phase; and the wheel and the resin bonding phase are chemically bonded by a silane coupling reaction via a silane coupling agent.

In the wheel of the sixth aspect, the abrasive grains dispersion-arranged over the entire wheel are held by the resin, and the abrasive grains and the resin are chemically bonded through a silane coupling reaction via the silane coupling agent. The abrasive grains are therefore not only physically held by the resin, but also chemically bonded and fixed. This intensifies the holding force of the abrasive grains, and extends the service life of the wheel.

BRIEF DESCRIPTION OF THE DRAWINGS

FIG. 1 An enlarged sectional view illustrating a first embodiment of the composite bond wheel of the present invention;

FIG. 2 An enlarged sectional view illustrating a second embodiment of the composite bond wheel of the invention;

FIG. 3 A view illustrating rigidity of the composite bond wheel of the invention;

FIG. 4 An enlarged sectional view illustrating a conventional metal bond wheel; and FIG. 5 An enlarged sectional view illustrating a conventional resin bond wheel.

Reference numerals:

11, 21: Composite bond wheel;
12: Abrasive grains;
13: Metal bonding phase;
14: Resin bonding phase;
15: Pores; and
16: Silane coupling agent.

DETAILED DESCRIPTION OF THE PREFERRED EMBODIMENTS

Various other objects, features and attendant advantages of the present invention will be more fully appreciated as the same becomes better understood from the following detailed description when considered in connection with the accompanying drawings in which like reference characters designate like or corresponding parts throughout the several views.

A first preferred embodiment of the composite bond wheel of the present invention will now be described with reference to FIG. 1. FIG. 1 is an enlarged sectional view illustrating the preferred composite bond wheel of the invention.

The composite bond wheel 11 of this embodiment of the invention, is formed into, for example, an annular plate, containing super-abrasive grains 12 including diamond abrasive grains, a metal bonding phase 13, and a resin bonding phase 14.

The super-abrasive grains 12 are dispersion-arranged over the entire composite bond wheel 11.

The metal bonding phase 13 is formed from a mixture of cobalt and other metals such as copper, tin and iron. The metal bonding phase 13 holds the super-abrasive grains 12, and has a structure in which pores 15 having an arbitrary shape opening outside are dispersion-arranged in the metal, i.e., a crosslinked structure with the metal.

The pores 15 provided in the metal bonding phase 13 account for 5 to 60 vol. % relative to the total volume of the composite bond wheel 11. With a volume of pores 15 of under 5 vol. %, a very strong holding force of the super-abrasive grins 12 make it difficult for self edging function to act. With a pore volume of over 60 vol. %, on the other hand, a mask holding force of the super-abrasive grains 12 results in a shorter service life of the composite bond wheel 11.

The resin bonding phase 14 is formed by a thermosetting resin such as a phenol resin. The resin fills the pores 15 in the metal bonding phase 13, and in addition, covers the outer surface of the metal bonding phase 13. At portions of the pores opening outside the metal bonding phase 13, therefore, the resin filling the individual pores 15 in the metal bonding phase 13 are bonded to the resin covering the outer surface, thus forming the crosslinked structure of the resin.

The metal bonding phase 13 and the resin bonding phase 14 are individually integrated into crosslinked structures, and the outer surfaces of the individual super-abrasive grains 12 are covered with the metal bonding phase 13 and the resin bonding phase 14, respectively. The super-abrasive grains 12 project however on the surface of the composite bond wheel 11.

The preferred manufacturing method of the composite bond wheel 11 of the present embodiment will be described.

The method includes the steps of first mixing the super abrasive grains 12, a powder of cobalt and other metals such as copper, tin and iron, and an organic binder such as methylcellulose, and kneading the resultant mixture so as to incorporate pores 15 in the mixture to generate a slurry material (step S1), while preventing the super-abrasive grains 12 and the metal powder from settling by imparting an appropriate viscosity to the slurry material so as to avoid collapse of the pores 15 therein.

The slurry material is formed into a plate having a prescribed thickness, dried, and then stamped into a rough prototype having an appropriate shape (step S2). The resultant rough prototype is subjected to a cold pressing to adjust the volume of the pores 15 in the rough prototype (step S3). Because the mass of the material composing the rough prototype is known, it is possible to determine a porosity in the rough prototype from the weight and volume of the rough prototype after cold pressing.

Then, the organic binder contained in the rough prototype is removed via decomposition or evaporation (step S4). This is accomplished by, for example, applying a heating treatment to the rough prototype placed in a heating furnace containing an inert atmosphere.

Upon the completion of removal of the organic binder, the rough prototype is sintered via a sintering treatment (step S5). As a result of this sintering, metal particles in the metal powder are bonded together to form a crosslinked structure, which forms the metal bonding phase 13. The super-abrasive grains 12 are held by the metal bonding phase 13 in a dispersion arrangement, and the pores 15 opening outside are dispersion-arranged.

Upon the completion of sintering, the rough prototype is impregnated with a thermosetting resin in a vacuum atmosphere and is subjected to a hot press treatment (step S6). As a result, the pores 15 of the metal bonding phase 13 are filled with the thermosetting resin. The outer surface of the metal bonding phase 13 is covered with the thermosetting resin to form the resin bonding phase 14. Therefore, the thermosetting resin filling the individual pores 15 and the thermosetting resin covering the outer surface of the metal bonding phase 13 are bonded together, thus forming a crosslinked structure of the thermosetting resin.

As a result, the metal bonding phase 13 and the resin bonding phase 14 are integrated together into respective crosslinked structures, and the super-abrasive grains 12 are held by the metal bonding phase 13 and the resin bonding phase 14, respectively.

Thereafter, a shape of the wheel is stamped from the rough prototype, and formed into a prescribed thickness through lap fabrication (step S7).

The composite bond wheel of this embodiment is provided with the above-mentioned configuration. The functions upon grinding by means of the composite bond wheel 11 will now be described.

The super-abrasive grains 12 project on the surface of the composite bond wheel 11, and grinding is accomplished by pressing the grains against the surface to be ground of the work. Because the super-abrasive grains 12 are held by the metal bonding phase 13 as well as by the resin bonding phase 14, elasticity is imparted to the holding of the super-abrasive grains 12 to alleviate the impact produced upon contact with the work.

During the grinding of the work, the super-abrasive grains 12 are gradually worn out and the tips thereof become dull. On the surface of the composite bond wheel 11, on the other hand, any one or both of the metal bonding phase 13 and the resin bonding phase 14 holding the super-abrasive grains 12 are exposed and worn out by friction with chips and the like produced during grinding. However, because the resin bonding phase 14 is milder or softer than the metal bonding phase 13, wear of the former is faster than that of the latter.

As the wear of the metal bonding phase 13 and the resin bonding phase 14 progresses, there is a decrease in the holding force of the super-abrasive grains 12 projecting from the surface of the composite bond wheel 11, and the super-abrasive grains 12 begin falling out at a point when the holding force becomes unable to withstand the grinding resistance. Thereafter, with further wear of the metal bonding phase 13 and the resin bonding phase 14, underlying fresh super-abrasive grains 12 project in turn on the surface as they are exposed.

In the composite bond wheel 11 of this embodiment as described above, the pores 15 opening outside are dispersion-arranged or dispersed in the metal bonding phase 13. The holding force of the super-abrasive grains 12 is reduced as compared to where the super-abrasive grains 12 are held by the metal alone. Self-edging takes place more easily during grinding, and a satisfactory sharpness can be maintained under the effect of repeated self-edging.

Preferably, the metal bonding phase 13 has a metal crosslinked structure, and bonding state is formed between metal particles, leaving no isolated portion. The holding force of the super-abrasive grains 12 is therefore stronger than in the case of holding the super-abrasive grains 12 by the resin alone, with a higher wear resistance available against friction with the work or chips, thus contributing to the extension of the service life of the wheel.

Preferably, the pores 15 are filled with the resin, and the resin is bonded together with the resin covering the outer surface of the metal bonding phase 13, and the resin bonding phase 14 of the crosslinked structure is formed. Elasticity is imparted to the super-abrasive grains 12 projecting on the surface of the composite bond wheel 11 as compared with the case of holding the super-abrasive grains 12 by the metal alone. This alleviates the mechanical impact produced between the work and the super-abrasive grains 12 during grinding, and it is possible to reduce scratches produced on the ground surface of the work and chipping produced on the cut surface.

Preferably, the metal bonding phase 13 contains cobalt (Co). When sintering the metal powder containing cobalt powder, sintering does not occur on the outer surfaces of the cobalt powder particles and there remains a relatively large non-reacting portion. It is therefore possible to increase the volume of the pores 15 dispersion-arranged in the metal bonding phase 13 after sintering, and adjust the volume of the pores 15 by adjusting the amount of cobalt powder.

Preferably, the metal bonding phase 13 and the resin bonding phase having respective crosslinked structures are integrated together, and the super-abrasive grains 12 are held by the metal bonding phase 13 and the resin bonding phase 14, respectively. It is therefore possible to improve simultaneously the grinding accuracy and the service life of the wheel while taking balance between the self-edging function and wear resistance. With a volume of the pores 15 filled with the resin of under 5 vol. % relative to the total volume of the composite bond wheel 11, the very strong holding force of the super-abrasive grains makes it difficult for the self-edging action to occur, resulting in a lower grinding accuracy. With a volume of over 60 vol. %, on the other hand, the very weak holding force of the super-abrasive grains 12 leads to a shorter service life of the wheel. By setting the volume within a range of from 5 to 60 vol. %, it is possible to avoid these problems. Preferably, the volume is 10–50 vol. %, more preferably, 15–45%, most preferably 20–40%. These and the above changes expressly include all values in between.

A second preferred embodiment of the composite bond wheel of the invention will now be described with reference to FIG. 2. The same portions as in the above-mentioned first embodiment will be assigned the same reference numerals and the description thereof will be simplified or omitted. FIG. 2 is an enlarged sectional view illustrating the composite bond wheel 21 of this embodiment.

The composite bond wheel 21 of this embodiment takes the form of, for example, a thin-blade for cutting, and is formed into an annular plate or the like. It includes super-abrasive grains 12, a metal bonding phase 13 and a resin bonding phase 14.

The super-abrasive grains 12 include, for example, diamond grains having surfaces covered with copper (Cu) or nickel (Ni), dispersion-arranged over the entire composite bond wheel 21, and project from the surface of the composite bond wheel 21.

The resin bonding phase 14 is formed with a thermosetting resin such as a phenol resin, and mixed with a silane coupling agent 16 including an organic silicon compound or the like.

The metal bonding phase 13 and the resin bonding phase 14 have respective crosslinked structures and are physically integrated together. The super-abrasive grains 12 are held by the metal bonding phase 13 and the resin bonding phase 14, respectively.

In addition, the resin bonding phase 14 contains the silane coupling agent 16 mixed therein. As a result, the super-abrasive grains 12 are chemically bonded with the metal bonding phase 13 and the resin bonding phase 14 through a silane coupling reaction via the silane coupling agent. The super-abrasive grains 12 are physically held by the metal bonding phase 13, and also, chemically bonded and fixed to the resin bonding phase 14. The resin bonding phase 14 is thus chemically bonded also to the metal bonding phase 13.

The preferred manufacturing method of the composite bond wheel 21 of this embodiment will now be described. However, since only step S5 is different from the above-mentioned first embodiment, description of steps S1 to S5 will be omitted, and a treatment after sintering will be described here.

The rough prototype after the completion of sintering is impregnated with a thermosetting resin in a vacuum atmosphere and subjected to hot pressing. The silane coupling agent 16 is previously mixed in the thermosetting resin in dispersion arrangement (step S11). As a result, the pores 15 of the metal bonding phase 13 are filled with the thermosetting resin. The outer surface of the metal bonding phase 13 is covered with the thermosetting resin to form the resin bonding phase 14. The thermosetting resin filling the individual pores 15 and the thermosetting resin covering the outer surface of the metal bonding phase 13 are bonded together, thus forming a crosslinked structure of the thermosetting resin.

As a result, the metal bonding phase 13 and the resin bonding phase 14 are physically integrated mutually into the respective crosslinked structures, and the super-abrasive grains 12 are held by the metal bonding phase 13 and the resin bonding phase 14, respectively. Further, the silane coupling agent 16 dispersion-arranged in the resin bonding phase 14 causes a silane coupling reaction between the super-abrasive grains 12 and the metal bonding phase 13 and between the super-abrasive grains 12 and the resin bonding phase 14. The super-abrasive grains 12 are thus physically held by the metal bonding phase 13, and chemically bonded and fixed to the resin bonding phase 14. The resin bonding phase 14 is chemically bonded also to the metal bonding phase 13.

Thereafter, the wheel shape is stamped from the rough prototype, which is lap-fabricated into a prescribed thickness (step S12).

The composite bond wheel 21 of this embodiment has the above-mentioned configuration. The operations upon grinding by the use of the composite bond wheel 21 will now be described.

In this case, the same operations as in the above-mentioned first embodiment are performed, and in addition, even when the resin bonding phase 14 is elastically deformed, no gap is produced between the resin bonding phase 14 and the super-abrasive grains 12, or between the resin bonding phase 14 and the metal bonding phase 13, because the resin bonding phase 14 is chemically bonded together with the super-abrasive grains 12 and the metal bonding phase 13 via the silane coupling agent 13.

The composite bond wheel 21 of this embodiment as described above can provide the same advantages as in the above-mentioned first embodiment, and in addition, a silane coupling reaction 16 takes place between the super-abrasive grains 12 and the metal bonding phase 13 and between the grains 12 and the resin bonding phase 14 and these are chemically bonded. Therefore, the super-abrasive grains 12 are physically held by the metal bonding phase 13, and chemically bonded and fixed to the resin bonding phase 14.

Because the resin bonding phase 14 is chemically bonded also to the metal bonding phase 13, the holding force of the super-abrasive grains 12 is further intensified, thus permitting contribution of a longer service life of the wheel.

In the above-mentioned first and second embodiments, each of the composite bond wheel 11 and 21 has taken the form of an annular plate composed of super-abrasive grains 12, a metal bonding phase 13 and a resin bonding phase 14. The present invention is not however limited to this, but the grain layer formed by the super-abrasive grains 12, the metal bonding phase 13 and the resin bonding phase 14 may be formed on a wheel base having any of various shapes.

Preferred abrasive grains include, not only diamond and CBN super-abrasive grains, but also general abrasive grains such as SiC and $Al_2O_3$. Other abrasive grains known to those of ordinary skill in the art may also be contemplated given the teachings herein.

Preferred metal powder forming the metal bonding phase 13 may include a mixture of cobalt powder and powder of the other metals such as copper, tin and iron. Alloys of these metals are also preferred, and further, in place of or in addition to the cobalt powder serving as a porous constituent, the metal powder may contain powder of, for example, nickel, iron, zinc or copper, and may contain, as combined constituents, powder of tin or silver.

Any thermosetting resin may be used in the resin bonding phase 14. Although phenol resin is most preferred, other preferable examples of thermosetting resins include phenolic resins, amino resins, polyester resins, aminoplast resins having pendant alpha, beta-unsaturated carbonyl groups, urethane resins, epoxy resins, urea-formaldehyde resins, isocyanurate resins, melamine-formaldehyde resins, acrylate resins, acrylated isocyanurate resins, acrylated urethane resins, acrylated epoxy resins, bismaleimide resins, and mixtures thereof.

Preferred silane coupling agents include compounds wherein silicon atoms are bonded with a an organic group such as hydrolytic group, amino groups, halogen atoms, alkoxy groups and the like, and partial hydrolytic condensates thereof. Preferred hydrolytic groups include an alkoxy group such as methoxy group and ethoxy group. Preferred organic groups include hydrocarbon groups or hydrocarbon groups substituted by nitrogen atoms, oxygen atoms, halogen atoms, sulfur atoms and the like. Silane coupling agents having organic groups such as primary or secondary amino groups or epoxy groups may also be preferably used. Examples of preferred silane coupling agents include vinyltrimethoxysilane, vinyltriethoxysilane, vinyl-tris(beta-methoxy-ethoxy)silane, vinyl triacetylsilane, vinyltriacethoxysilane, methyltrimethoxysilane, methyltriethoxysilane, isopropyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane and n-octadecyltrimethoxysilane, gamma-methacryloxypropyl trimethoxysilane, beta-(3,4-epoxycyclohexyl) ethyltrimethoxysilane, gamma-glycidoxypropylmethyldimethoxysilane, gamma-glycidoxypropylmethyldiethoxysilane, gamma-glycidoxypropylethyldimethoxysilane, N-beta-(aminoethyl) aminopropyltrimethoxysilane, N-beta-(aminoethyl) aminopropylmethyldimethoxysilane, N-beta-(aminoethyl) aminopropylethyldimethoxysilane, gamma-aminopropyltriethoxysilane, N-phenyl-gamma-aminopropyltrimethoxysilane, gamma-N-(beta-methacryloxyethyl)-N,N-dimethyl-ammonium(chloride) propylmethoxysilane, and styryldiaminosilane, and mixtures thereof.

Preferably, in the aforementioned first and second embodiments, the pores 15 of the metal bonding phase 13 are filled with a thermosetting resin. The present invention is not however limited to this, and it is not always necessary that the pores 15 are completely filled with the thermosetting resin.

An especially preferred embodiment is described below, which is not intended to be limiting unless otherwise specified. Super-abrasive grains 12 are dispersion-arranged over the entire composite bond wheel 21. The metal bonding phase 13 has pores 15 opening outside dispersion-arranged in the metal containing cobalt. The pores 15 are filled with a thermosetting resin, and the outer surface of the metal bonding phase 13 is covered with the thermosetting resin to form a resin bonding phase 14 having a crosslinked structure. A silane coupling agent 16 is mixed in, and dispersion-arranged in the resin bonding phase 14. The metal bonding phase 13 and the resin bonding phase 14 are physically integrated into respective crosslinked structures, and chemically bonded together through a silane coupling reaction via the silane coupling agent 16. The abrasive grains 12 are physically held by the metal bonding phase 13, and chemically bonded and fixed to the resin bonding phase 14.

Another especially preferred embodiment, which is not intended to be limiting includes the composite bond wheel, wherein the wheel has a resin bonding phase, wherein the abrasive grains are dispersion-arranged in said resin bonding phase; and said wheel and said resin bonding phase are chemically bonded by a silane coupling reaction via a silane coupling agent.

EXAMPLES

Having generally described this invention, a further understanding can be obtained by reference to certain specific examples, which are provided herein for purposes of illustration only and are not intended to be limiting unless otherwise specified.

An example of the manufacturing method of the composite bond wheel will now be described.

A mixed metal powder containing 30 wt. % Cu, 5 wt. % Sn, 15 wt. % Fe and 50 wt. % Co is mixed with an organic binder and diamond abrasive grains of, for example, "#600", and kneaded so as to incorporate pores to produce a slurry material. The slurry material was formed into a plate shape and dried to produce a wheel material.

A rough prototype of wheel was obtained by rough stamping of this wheel material with a press die. Each rough prototype was subjected to cold pressing under a pressure of 200 tons per piece and temporarily formed to achieve a porosity within a range of from 5 to 60 vol. % in the rough prototype.

The temporarily formed rough prototype was heated at 420° C. for 60 minutes to eliminate the binder, and then sintered at 700° C. for 30 minutes, thereby forming a metal bonding phase. As a result, the diamond abrasive grains were held in dispersion arrangement by the metal bonding phase, and pores opening outside were dispersion-arranged in the metal bonding phase.

Then in a vacuum, the rough prototype was impregnated with, for example, resinoid, a "liquid resin". The rough prototype was then heated to 180° C., and subjected to a hot pressing under a pressure of 0.5 tons for 10 minutes. As a result, the pores were filled with resinoid, and the outer surface of the metal bonding phase was covered with resinoid to form a resin bonding phase.

The metal bonding phase and the resin bonding phase were integrated into respective crosslinked structures, and the diamond abrasive grains were held by the metal bonding phase and the resin bonding phase, respectively.

Thereafter, the rough prototype was stamped with a press die, lapped, thereby obtaining a composite resin-metal bond wheel.

A cutting test carried out on the composite bond wheel 11 of the embodiment will be described. The composite bond wheel 11 of the above-mentioned embodiment is referred to as an example; a resin bond wheel comprising dispersion-arranged diamond super-abrasive grains in a resin bond phase comprising a resin such as a polyimide resin is referred to as a comparative example 1; and a metal bond wheel comprising dispersion-arranged diamond super-abrasive grains in a metal phase comprising, for example, Cu—Sn is referred to as a comparative example 2.

Measured values of rigidity for example 1, and comparative examples 1 and 2 are shown in FIG. 3.

For the composite bond wheel 11 of example was confirmed to have a rigidity in the middle between the resin bond wheel and the metal bond wheel.

In the cutting test, the composite bond wheel 11, the resin bond wheel and the metal bond wheel of example and comparative examples 1 and 2 were formed into annular plate-shaped thin blades with an outside diameter of 98 mm, and inside diameter of 40 mm and a thickness of 0.15 mm.

Cutting of an alumina (content: 99.6%) work having a thickness of 0.5 mm was carried out at revolutions of the thin blade of 10,000 rpm, into cut lengths of 10 mm by changing the table feed speed f.

For example and comparative examples 1 and 2, the main shaft current value (A) of the main shaft motor and the amount of radial wear ($\mu$m) of the thin blade were measured. The main shaft current value (A) of the main shaft motor means a current value (A) necessary for rotating the main shaft motor at a prescribed speed upon cutting the alumina work while rotating the thin blade at a constant speed of 10,000 rpm. The measured value of current fed to this main shaft motor was used as a cutting resistance.

The results of measurement of the main shaft current value (A) are shown in Table 1, and the measured values of the amount of wear ($\mu$m) are shown in Table 2.

TABLE 1

| | Main shaft current value (A) | | | | | |
|---|---|---|---|---|---|---|
| | f = 4 mm/sec. | f = 6 mm/sec. | f = 8 mm/sec. | f = 10 mm/sec. | f = 16 mm/sec. | f = 20 mm/sec. |
| Comparative Example 1 | 6.1 | 6.1 | 6.2 | 6.2 | 6.4 | 6.4 |
| Comparative Example 2 | 6.8 | work broken | — | — | — | — |
| Example | 6.1 | 6.1 | 6.1 | 6.2 | 6.2 | 6.3 |

TABLE 2

| | Blade wear ($\mu$m) | | | | | |
|---|---|---|---|---|---|---|
| | f = 4 mm/sec. | f = 6 mm/sec. | f = 8 mm/sec. | f = 10 mm/sec. | f = 16 mm/sec. | f = 20 mm/sec. |
| Comparative Example 1 | 160 | 180 | 200 | 220 | 260 | 300 |
| Comparative Example 2 | 50 | work broken | — | — | — | — |
| Example | 90 | 100 | 100 | 120 | 130 | 150 |

The results shown in Table 1 suggest that, at a higher table feed speed f, the metal bond wheel of comparative example 2 has an increased cutting resistance, leading to breakage of the work, whereas the composite bond wheel 11 of example exhibits only a cutting resistance of the same order as that for the resin bond wheel of comparative example 1, and there is only a slight increase in cutting resistance even at a higher table feed speed f.

The results shown in Table 2 permits confirmation that the composite bond wheel 11 of example shows an amount of wear only about a half that for the resin bond wheel of comparative example 1, thus resulting in a longer service life of the wheel.

According to the composite bond wheel of the first aspect of the present invention, as described above, the holding force of the abrasive grains is reduced as compared with the case of holding abrasive grains by the metal alone as in the metal bond wheel because pores opening outside are dispersion-arranged in the metal. Falling of the abrasive grains occurs on the surface of the composite bond wheel upon wheel, because the holding force of the abrasive grains is reduced as compared with holding of the abrasive grains with the metal alone, leasing to easier occurrence of self-edging. Since the pores are dispersion-arranged over the entire metal, self-edging function acts repeatedly during grinding, thereby permitting maintenance of a satisfactory sharpness.

Further, because the pores are filled with the resin, elasticity is imparted particularly to abrasive grains projecting on the surface of the composite bond wheel, more remarkably as compared with the case of holding the abrasive grains by the metal alone. This makes it possible to alleviate a mechanical impact produced between the work and the abrasive grains upon grinding, and reduce scratches produced on the ground surface of the work and chipping produced on the cut surface.

The metal has a crosslinked structure, and a mutual bonding state is achieved between metal particles, leaving not isolated portion. There is therefore available a stronger holding force of the abrasive grains as compared with the case of holding the abrasive grains with the resin alone as in the resin bond wheel, and a higher wear resistance against frictions with the work or chips, thus permitting contribution of the extension of service life of the wheel. Further, because of a satisfactory thermal conductivity, and a higher strength, the composite bond wheel is applicable as a thin-blade wheel or a thin blade.

In the composite bond wheel of the second aspect of the invention, the metal preferably contains cobalt (Co). It is therefore possible to increase the volume of pores contained in the metal after sintering, and adjust the volume of pores by adjusting the amount of cobalt powder.

In the composite bond wheel of the third aspect of the invention, with a volume of pores of under 5 vol. % relative to the total volume of the grain layer, a very strong holding force of the abrasive grains makes it difficult for self-edging function to act, leading to a lower grinding accuracy. With a volume of over 60 vol. %, on the other hand, a very weak holding force of the abrasive grains results in a shorter service life of the composite bond wheel.

Further, according to the composite bond wheel of the fourth aspect of the invention, the metal and the resin have respective crosslinked structures. The abrasive grains are therefore by both the metal and the resin, and it is possible to improve the grinding accuracy and the service life of the wheel while keeping balance between the self-edging function and wear resistance. In addition, elasticity is increased in holding the abrasive grains projecting on the surface of the composite bond wheel. During grinding of, for example, a hard and brittle material, it is possible to reduce scratches produced on the ground surface and chipping produced on the cut surface and the work end surface, thereby improving the surface quality of the finished work.

In the composite bond wheel of the fifth aspect of the invention, the abrasive grains and the resin, and the metal and the resin, are chemically bonded together through a silane coupling reaction via the silane coupling agent. The abrasive grains are physically held by the metal, and at the same time, chemically bonded and fixed to the resin, and the resin is chemically bonded together also with the metal. The holding force of the abrasive grains is thus further intensified, thus contributing to the extension of the service life of the wheel.

According to the wheel of the sixth aspect of the invention, the abrasive grains are not only physically held by the resin, but also chemically bonded and fixed. As a result, the holding force of the abrasive grains is increased, thereby permitting extension of the service life of the wheel.

Having now fully described this invention, it will be apparent to one of ordinary skill in the art that many changes and modifications can be made thereto without departing from the spirit or scope of the invention as set forth herein.

This application is based on Japanese patent applications, HEI 10-272295, filed Sep. 25, 1998, and HEI 10-316650, filed Nov. 6, 1998, the entire contents of each of which are hereby incorporated by reference.

What is claimed is:

1. A composite bond wheel, comprising:

a grain layer comprising abrasive grains and a bonding phase;

wherein the bonding phase comprises a metal bonding phase and a resin bonding phase, wherein said metal bonding phase comprises a metal having said abrasive grains and outside-opening pores dispersed therein, and wherein at least a portion of said outside-opening pores are filled with a resin of the resin bonding phase, and wherein said metal bonding phase has an outer surface, which is covered by the resin of the resin bonding phase.

2. The composite bond wheel according to claim 1, wherein said metal is selected from the group consisting of cobalt, copper, nickel, zinc, tin, silver, and iron, and alloys and mixtures thereof.

3. The composite bond wheel according to claim 1, wherein said pores are present in an amount of 5 to 60 vol. % relative to the total volume of said grain layer.

4. The composite bond wheel according to claim 1, wherein said metal bonding phase and said resin bonding phase are physically integrated to form a crosslinked structure.

5. The composite bond wheel according to claim 1, wherein said abrasive grains are held by said metal bonding phase and said resin bonding phase.

6. The composite bond wheel according to claim 1, wherein said resin bonding phase comprises a silane coupling agent, and wherein said abrasive grains, said resin bonding phase and said metal bonding phase are chemically bonded together by the silane coupling agent.

7. The composite bond wheel according to claim 1, where said abrasive grains are selected from the group consisting of SiC, $Al_2O_3$, diamond, and CBN, and mixtures thereof.

8. The composite bond wheel according to claim 7, wherein said abrasive grains further comprise a surface having a coating selected from the group consisting of copper and nickel and a mixture thereof.

9. The composite bond wheel according to claim 1, wherein said resin comprises a thermosetting resin.

10. The composite bond wheel according to claim 1, which is in the form of a sharp-edged wheel or thin edged blade.

11. The composite bond wheel according to claim 1, further comprising a wheel base.

12. A device selected from the group consisting of a grinding machine, cutting machine, grooving machine, and polishing machine, comprising the composite bond wheel according to claim 1.

13. A composite bond wheel, comprising:

a grain layer comprising abrasive grains and a bonding phase;

wherein the bonding phase comprises a metal bonding phase and a resin bonding phase, wherein said metal bonding phase comprises a metal having said abrasive grains and outside-opening pores dispersed therein, wherein at least a portion of said outside-opening pores are filled with a resin of the resin bonding phase, wherein said metal bonding phase has an outer surface, which is covered by the resin of the resin bonding phase, and wherein the metal bonding phase and the resin bonding phase have a crosslinked structure.

14. The composite bond wheel according to claim 13, wherein said crosslinked structure comprises a structure wherein the metal bonding phase and the resin bonding phase are chemically bonded together.

15. The composite bond wheel according to claim 13, wherein the abrasive grains are physically held by the metal bonding phase and chemically bonded to the resin bonding phase.

16. The composite bond wheel according to claim 13, wherein the metal bonding phase and the resin bonding phase are chemically bonded together with a silane coupling agent.

17. The composite bond wheel according to claim 13, wherein said metal is selected from the group consisting of cobalt, copper, nickel, zinc, tin, silver, and iron, and alloys and mixtures thereof.

18. The composite bond wheel according to claim 13, wherein said pores are present in an amount of 5 to 60 vol. % relative to the total volume of said grain layer.

19. The composite bond wheel according to claim 13, where said abrasive grains are selected from the group consisting of SiC, $Al_2O_3$, diamond, and CBN, and mixtures thereof.

20. The composite bond wheel according to claim 1, wherein the resin that fills said outside-opening pores and the resin that covers said outer surface of the metal bonding are bonded together.

21. The composite bond wheel according to claim 13, wherein the resin that fills said outside-opening pores and the resin that covers said outer surface of the metal bonding are bonded together.

22. The composite bond wheel according to claim 20, wherein said abrasive grains are held by the metal bonding phase and the resin bonding phase.

23. The composite bond wheel according to claim 21, wherein said abrasive grains are held by the metal bonding phase and the resin bonding phase.

* * * * *